US009375964B2

(12) United States Patent
Koehler et al.

(10) Patent No.: US 9,375,964 B2
(45) Date of Patent: Jun. 28, 2016

(54) METHOD FOR COMPENSATING FOR FAILED PRINTING NOZZLES IN INKJET PRINTING SYSTEMS

(71) Applicant: HEIDELBERGER DRUCKMASCHINEN AG, Heidelberg (DE)

(72) Inventors: Hans Koehler, Edingen-Neckarhausen (DE); Ralf Tita, Hirschhorn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/940,358

(22) Filed: Nov. 13, 2015

(65) Prior Publication Data

US 2016/0136983 A1 May 19, 2016

(30) Foreign Application Priority Data

Nov. 13, 2014 (DE) ..... 10 2014 223 131

(51) Int. Cl.
*B41J 29/393* (2006.01)
*B41J 2/01* (2006.01)

(52) U.S. Cl.
CPC . *B41J 29/393* (2013.01); *B41J 2/01* (2013.01)

(58) Field of Classification Search
CPC ..... B41J 2/2139; B41J 2/2142; B41J 29/393
USPC ..... 347/19
See application file for complete search history.

(56) References Cited

U.S. PATENT DOCUMENTS 6,695,435 B1 2/2004 Cheng et al.
7,265,770 B2 9/2007 Faken et al.
7,607,752 B2 10/2009 Childers et al.
7,784,897 B2 * 8/2010 Fletcher ..... B41J 29/393 347/19
2006/0061616 A1 3/2006 Yamazaki
2006/0125850 A1 6/2006 Kim et al.
2006/0256157 A1 11/2006 Kim et al.
2006/0268034 A1 11/2006 Lee et al.
2012/0075373 A1 3/2012 Ito
2012/0147078 A1 6/2012 Takagi et al.
2013/0070009 A1 * 3/2013 Yoshida ..... B41J 2/04541 347/9

FOREIGN PATENT DOCUMENTS

EP 1033251 A1 * 9/2000 ..... B41J 2/2139
EP 1536371 A1 6/2005

* cited by examiner

*Primary Examiner* — Julian Huffman
*Assistant Examiner* — Sharon A Polk
(74) *Attorney, Agent, or Firm* — Laurence A. Greenberg; Werner H. Stemer; Ralph E. Locher

(57) ABSTRACT

A method for compensating failed printing nozzles in inkjet printing machines using a control computer, includes printing a test form for a material combination, evaluating the print and creating a look-up table having compensation probabilities for local surface density, detecting a failed nozzle, reading the size of the intended droplet to be compensated at the failed nozzle, calculating local surface density at the failed nozzle, reading a compensation probability from the table with the calculated local surface density, calculating a pseudo-random number for adjacent pixels right and left of the pixel to be compensated, increasing the droplet size for adjacent pixels if the pseudo-random number therefor is lower than the compensation probability from the table, calculating adjacent droplet sizes for all intended droplets at the failed nozzle and using the changed droplet sizes in printing data. The print job is carried out with changed printing data.

11 Claims, 9 Drawing Sheets

Test form for determining the compensation LUT

METHOD FOR COMPENSATING FOR FAILED PRINTING NOZZLES IN INKJET PRINTING SYSTEMS

CROSS-REFERENCE TO RELATED APPLICATION

This application claims the priority, under 35 U.S.C. §119, of German application DE 10 2014 223 131.0, filed Nov. 13, 2014; the prior application is herewith incorporated by reference in its entirety.

BACKGROUND OF THE INVENTION

Field of the Invention

The present invention relates to a method for compensating for failed printing nozzles in inkjet printing systems.

The invention lies in the technical field of digital printing.

In general, inkjet printing machines include one or more print heads and each print head includes a multiplicity of printing nozzles. The inkjet printing machines use the nozzles for printing, in that ink is emitted. Those printing machines have nozzle plates with specific configurations of individual nozzles which permit a resolution up to 1200 dpi. That requires nozzle spacings of about 20 μm. In the event of failure of an individual printing nozzle, areas which cannot be imaged by the nozzle provided for that purpose in the individual color separation according to BCMY are produced. Color-free points are therefore produced, which can manifest themselves as white lines. If a multicolor print is involved, then the corresponding color is missing at that point and the color values are distorted. It is also necessary to take note that the course of a jet from an individual nozzle does not extend ideally but can deviate more or less therefrom. In addition the size of a jetted dot has to be taken into account. Thus, a malfunctioning nozzle relates to the printing quality of each printed document. The causes for the failure of individual nozzles are varied and they can be a temporary failure or a permanent failure.

A plurality of approaches to compensation is known from the prior art in order to reduce the effects on the printed image, in particular in full-tone areas. In one of those approaches, an attempt is made to cover the error by using other nozzles in the same color and the same inkjet unit. That means that, for the purpose of compensating for individual failed inkjet printing nozzles, following the determination as to which individual nozzle is involved, the adjacent nozzles are driven in such a way that the dot sizes of those nozzles are enlarged in such a way that the location of the failed nozzle is also covered. The adjacent nozzles therefore also co-write the image of the failed nozzle. White lines which arise as a result of the non-printing of individual nozzles can thus be prevented. U.S. Patent Application US 2006/0125850 A1 describes a method and a printing machine which operate in accordance with that principle. However, the method has effects on the printed image—in particular it becomes problematic if a plurality of directly adjacent nozzles fails. Compensation over the doubled or multiple distance is only poorly possible.

A further known approach resides in replacing the failed printing nozzle by the nozzles of the respective other printing inks used at the same location. In that case, an attempt is made, by using specific and controlled overprinting of the colors that are still available, to come as close as possible to the failed printing ink. As a result, neither redundancy in printing nozzles or print heads is required nor does the failure of adjacent printing nozzles constitute a problem. However, the main disadvantage of that compensation method is that it can be used only for multi-color printing. In addition, there is a high requirement for computing and control by the computer of the printing machine in order to determine the necessary color combinations. In addition—depending on the color distance of the failed color from the still printable color space of the remaining colors—the resulting printed result can quite possibly deviate considerably from the intended values.

Other approaches to compensating for failed printing nozzles provide double printing units in the same color, in order to be able to compensate for the failure of individual nozzles through redundancy. Examples of that procedure are known from U.S. Patent Applications US 2006/0256157 A1 and US 2006/0268034 A1. Although that is efficient, it is also correspondingly expensive, needs additional overall space and brings with it further problems, such as the more complicated control of the doubled units.

A further known approach is to carry out compensation through printing nozzles from other systems. That means that a plurality of positionable print heads is used to print an image. If printing nozzles fail, the print heads are repositioned in order to replace the failed nozzle as well as possible. U.S. Patent Application US 2012/0075373 A1 and U.S. Pat. No. 7,607,752 B2 disclose methods which implement that approach. In that case, too, de facto redundancy of print heads of the same color is required, which brings with it the problems already mentioned.

SUMMARY OF THE INVENTION

It is accordingly an object of the invention to provide a method for compensating for failed printing nozzles in inkjet printing systems, which overcomes the hereinafore-mentioned disadvantages of the heretofore-known methods of this general type with regard to redundant hardware and insufficient performance.

With the foregoing and other objects in view there is provided, in accordance with the invention, a method for automatically compensating for failed printing nozzles in an inkjet printing machine by using a control computer, including the following steps:

1. printing a test form for a specific material combination,
2. evaluating the print of the test form and creating a look-up table including compensation probabilities from 0 to 1 as a function of local surface density,
3. detecting a failed printing nozzle,
4. reading from the printing data the size of the intended droplet to be compensated for at the location of the failed printing nozzle,
5. calculating the local surface density at the location of the failed printing nozzle,
6. reading a compensation probability from the look-up table with the calculated local surface density,
7. calculating a pseudo-random number between 0 and 1 for the respectively adjacent pixel on the right and left of the pixel to be compensated for,
8. increasing the droplet size by 1 for the adjacent pixels on the right and left of the pixel to be compensated for if the respectively associated pseudo-random number for this pixel is lower than the compensation probability read from the look-up table,
9. calculating the adjacent droplet sizes for all the intended droplets to be compensated for at the location of the failed printing nozzle and using the changed droplet sizes in the printing data, and 10. carrying out the print job with the changed printing data.

The principle of the method according to the invention is compensating for failed printing nozzles by using adjacent printing nozzles. For this purpose, a look-up table is created which contains the compensation probabilities from 0 to 1 as a function of the surface density. This is done in a first, preparatory method step, which is carried out once for a specific material combination. A test form with various color densities is printed, wherein artificially introduced missing nozzle errors, which have been corrected with different compensation intensities, occur in the color densities. The test form is printed for the above-described material combination. A decision is then made visually as to the compensation intensity for each color density at which the best compensation effect is achieved. This is optimal when neither a light nor a dark line can be detected. The evaluation can also be carried out with the aid of a camera with connected image processing. The values determined are stored in a look-up table (LUT) that is specific to the material combination.

If a missing nozzle error occurs during operation of the inkjet printing machine, then the correction mode is activated. Since, according to experience in practical use, some nozzles have virtually always failed, this correction mode is the standard mode of use of the printing machine. For the purpose of correcting one or more that have failed, the intended droplet that is to be compensated for is read from the printing data. In this case, the intended droplet is that droplet which the failed printing nozzle would have been intended to discharge. If no droplet is set on the left or right beside the droplet, the droplet to be printed is placed there and the next is processed. As a result, pixel-wide structures are merely displaced and not hidden or depicted non-sharply, since if both adjacent pixels are not set, no compensation through the adjacent printing nozzles is possible. If both adjacent pixels are occupied, first of all the local surface density is calculated. By using the calculated local surface density, the compensation probability is loaded from the above described LUT. In this case, recourse can be had to the nearest value in the LUT or, if appropriate, linear interpolation can be carried out. In the next step, both for the pixel on the left and the pixel on the right beside the pixel to be compensated for, a pseudo-random number R is calculated in the value range between 0 and 1. If the random number is smaller than the compensation probability loaded from the LUT, the droplet size is increased by one step. The random factor introduced in this way is necessary since, in an inkjet printing process, areas are printed in the form of a grid. Thus, for example in the case of a print of a gray area with color density 50%, in each case half of the black droplets of the area are set, since the area is produced by using black ink and not with a "gray ink." If a nozzle in this 50% area fails, then the compensation by using enlarged adjacent droplets must naturally likewise be carried out only in 50% of the pixels on average, since otherwise it would not be a gray line that would be produced for the compensation but a black line—which is just as undesired as a white line (produced by failure of the printing nozzle). This is made possible by the random number. The number loaded from the LUT is 0.5 in the example cited. In half of all cases, the random number will be less than 0.5. The process is then carried out for the next line in the image.

The advantage of this method is, firstly, as compared with known compensation methods with redundant printing systems or nozzles, the omission of just this expensive redundancy, secondly, as compared with compensation methods with ink of a different color at the same location, in particular the possible use in single-color printing. In multi-color printing, the result is additionally more accurate with regard to target color density. Furthermore, the method according to the invention has the advantage that the substrate dependence of the compensation can be accommodated flexibly. The intensity of the compensation can be controlled for every color density, which means that over-compensation and under-compensation can be avoided. The result of the compensation includes random structures. This improves the image quality, since the human eye reacts very sensitively to regular structures. A further advantage lies in the possible implementation as a last step within the image processing chain. As a result it is possible to react flexibly to newly failed nozzles. Likewise the displacement of the output images transversely with respect to the printing direction, which often occurs, is also possible without printing having to be stopped for a recalculation. The method is independent of the manner in which the malfunction of the nozzles is detected.

In accordance with another preferred mode of the invention, values between 1 and n are possible as droplet sizes and the adjacent pixels on the right and left of the pixel to be compensated for are increased by the next largest droplet size, depending on the respectively associated pseudo-random number for this pixel.

Depending on the use of the print head, this intended droplet can generate with a specific number of droplet sizes. The more sizes these are, the more graduations are possible in the method according to the invention for compensating for failed printing nozzles by using the intended droplets of the adjacent pixels.

In accordance with a further preferred mode of the invention, the look-up table contains compensation probabilities from 0 to 2 or higher, the pseudo-random number for the respective pixel accordingly lies between 0 and 2, and therefore an increase in the droplet size for the compensation by 2 or more is possible.

If compensation probabilities higher than 1 are used, the use of a plurality of increments of the adjacent droplets or printing nozzles is therefore also possible. For this purpose, random numbers between 0 and 2 are accordingly used. In this case, the compensation is more accurate, since more efficient control is possible as a result of different compensation sizes.

In accordance with an added preferred mode of the invention, the material combination contains all the parameters determining the print output quality, in particular the substrate, the ink, the application method, the resolution, the drying parameters and the screening process.

Since each of these parameters can influence the printed result, all the parameters of the combination have to be taken into account. In addition, the LUT is only valid for the material combination with which the test form used for the calculation was printed.

In accordance with an additional preferred mode of the invention, the test form is composed of a color density wedge with various color densities into which simulated errors of failed printing nozzles have been introduced.

The color density wedge contains a plurality of color densities in which artificial missing nozzle errors have been introduced, in each case transversely with respect to the course of the color densities.

In accordance with yet another preferred mode of the invention, the intended droplet to be compensated for is in each case placed on the right or left of the location of the adjacent pixel if no droplet is set on this adjacent pixel.

If the pixel on the right and/or left of the failed printing nozzle is not set, the failed printing nozzle cannot be replaced by its adjacent nozzles, since they have no intended droplets which could be enlarged for the purpose of compensation. Therefore, in this case the intended droplet, that is to say the pixel of the failed nozzle, is simply displaced by one pixel to the right or left. A displacement of the pixel by one pixel width is no problem, given an appropriately high pixel resolution, since it is barely perceptible to the human eye.

In accordance with yet a further preferred mode of the invention, the calculation of the local surface density is carried out over a grid of 5×5 pixels. The necessary calculation of the local surface density is carried out over a 5×5 grid of the surrounding pixels.

In accordance with yet an added preferred mode of the invention, the sum of the droplet sizes in the 5×1 rows of the pixel grid is stored in a ring buffer and the calculation of the local surface density is carried out by using the sum of the elements of the ring buffer.

Since the compensation for a failed nozzle is to be carried out for an entire column, the calculation of the local surface density can be optimized. For this purpose, the 5×1 row sums are stored in a five-element ring buffer. In order to calculate the local color density, work is then carried out with the sum of the elements of the ring buffer. This corresponds to the sum over all the pixels of the 5×5 matrix. With this step, both the number of computational steps and that of the memory accesses is minimized.

In accordance with yet an additional preferred mode of the invention, in the case of multicolor printing the method is used independently for the print head of each color.

If multicolor printing is carried out, then the method according to the invention has to be carried out for all the involved print heads of all colors. Since the failure distribution of the printing nozzles is different in each print head, the methods are independent of one another. A test form therefore also has to be processed and a corresponding LUT has to be created for each color.

In accordance with again another preferred mode of the invention, the method is carried out during the screening by the Workflow control computer or in the printing machine by the local control computer of the printing machine.

The method described can be implemented both within the image pre-processing Workflow—that is to say in the raster processor—and also within the printing machine itself in the drive unit of the printing nozzles. The implementation within the printing machine (image setting unit) has the advantage that it is possible to react flexibly to the change in the nozzle state of a print head. Furthermore, even when using a digital transverse register adjustment in the printing machine, the compensation correction within the printing machine is able to react immediately to the register change. The compensation is thus the last processing step before the generation of the voltage waveforms for driving the printing nozzles. The printing data can thus be modified in real time and does not have to be stored.

In accordance with a concomitant preferred mode of the invention, the calculation and performance of the compensation are carried out in an automated manner by the control computer of the printing machine.

The performance of the method according to the invention is a constituent part of a printing machine control system and can be carried out expediently only within the context of automated performance by an internal or external control computer.

Other features which are considered as characteristic for the invention are set forth in the appended claims.

Although the invention is illustrated and described herein as embodied in a method for compensating for failed printing nozzles in inkjet printing systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The method according to the invention and functionally advantageous developments of the method will be described in more detail below with reference to the appended drawings and by using at least one preferred exemplary embodiment. In the drawings, mutually corresponding elements are provided with the same designations in each case.

DETAILED DESCRIPTION OF THE INVENTION

Figure 1:
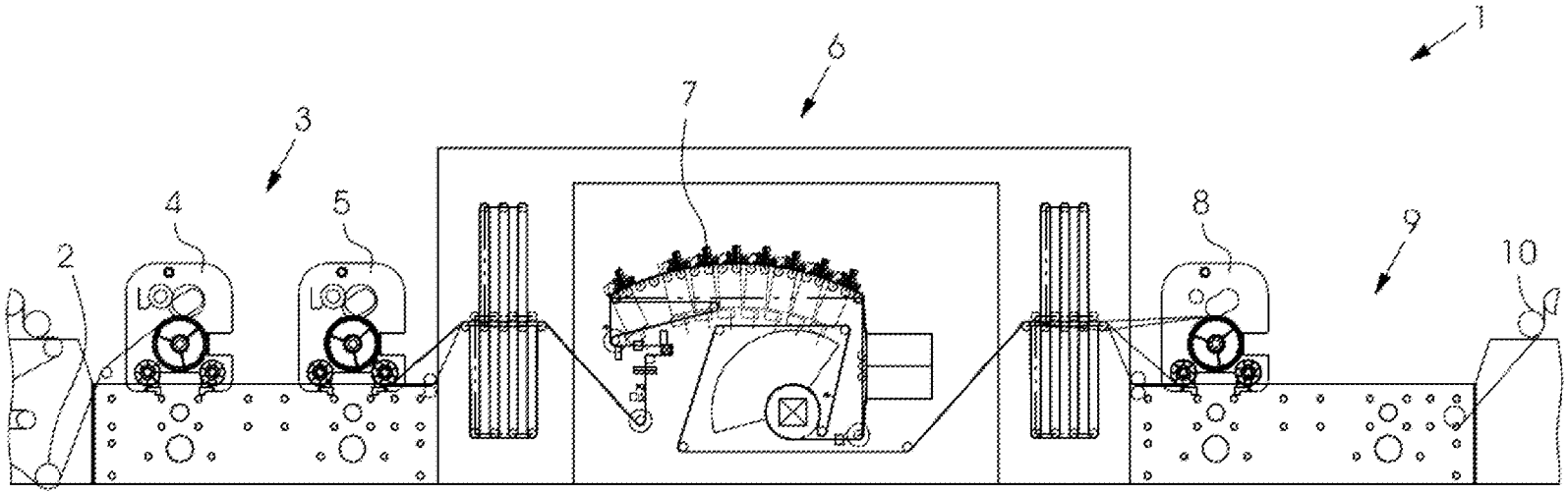
FIG. 1 is a diagrammatic, longitudinal-sectional view of an example of an inkjet web-fed printing machine.
Figure 2:
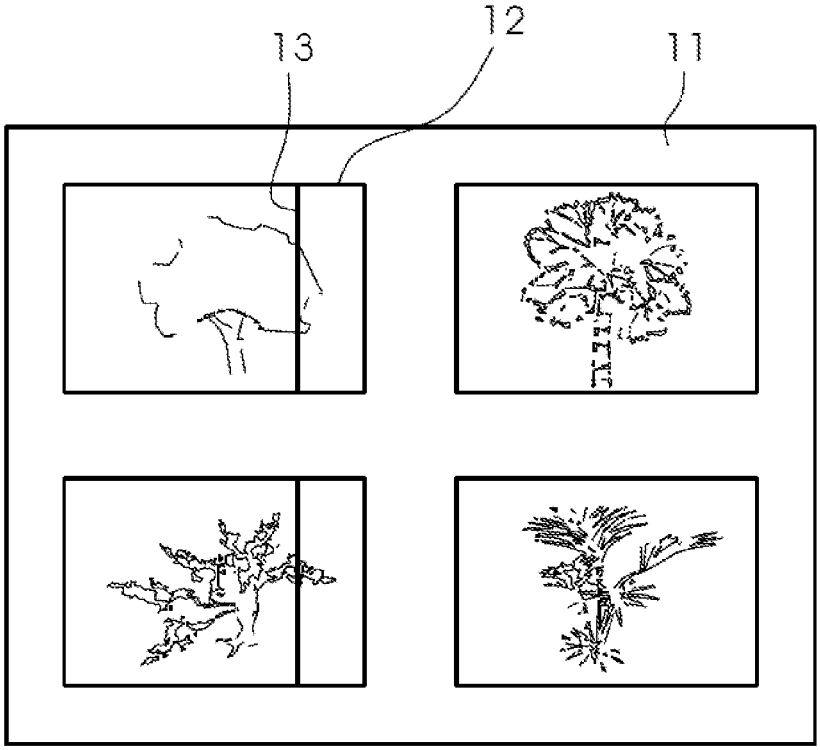
FIG. 2 is a plan view of an example of a defective image caused by a printing nozzle failure.

Referring now to the figures of the drawings in detail and first, particularly, to FIG. 1 thereof, there is seen an inkjet web-fed printing machine 1 which is the area of application of the preferred structural variant. An example of the structure of such a machine 1 is illustrated in FIG. 1. A web is unwound from a reel and fed over a roller 2 to a flexographic unit 4 for white or full areas, which is followed by a flexographic unit 5 for a primer, within a print preparation stage 3. The print preparation stage 3 is followed by a printing unit 6 having print heads 7. Following the printing unit 6 is a further processing stage 9 having a flexographic unit 8 for varnish and a roller 10 leading to a take-up reel for the web. During the operation of this printing machine 1, as already described at the beginning, it is possible for individual printing nozzles in print heads 7 in a printing unit 6 to fail. The consequence is white lines 13 or, in the case of a multicolor print, distorted color values. One example of such a white line 13 is illustrated in a copy 12 on a printing substrate 11 in FIG. 2.

Figure 3:
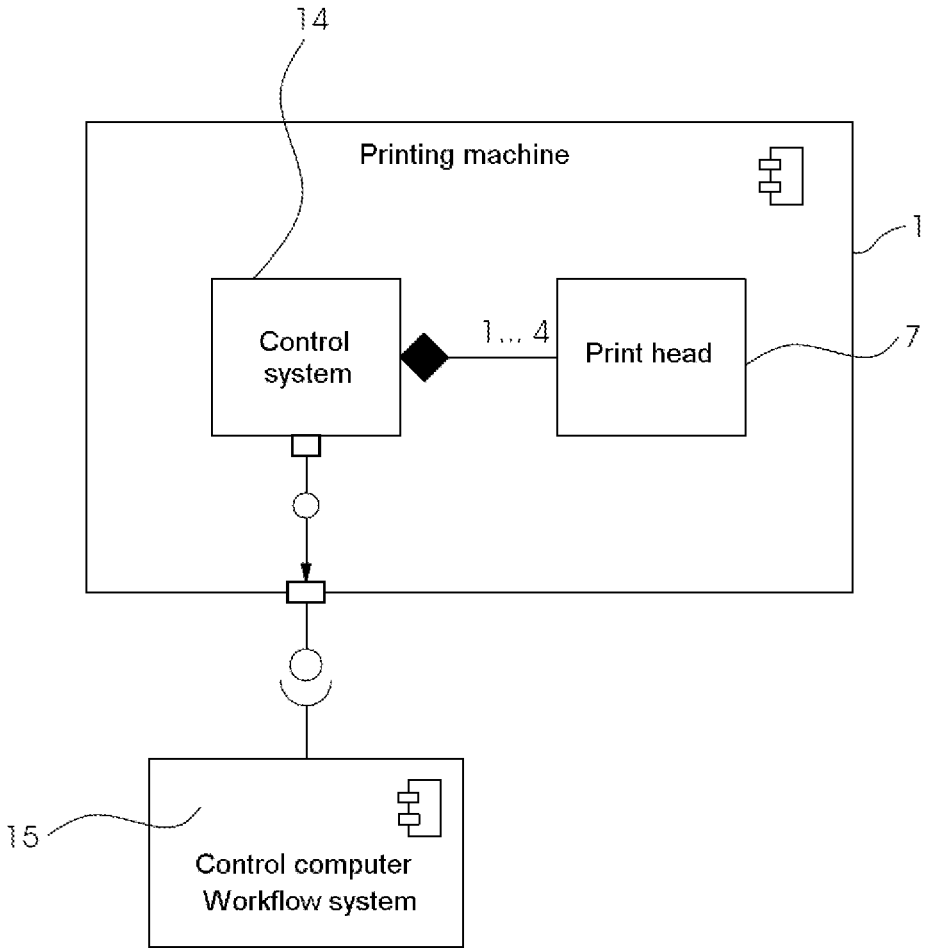
FIG. 3 is a block diagram showing the structure of the printing machine system being used.

Since performing the described method manually by a user would be inefficient, the method is performed in an automated manner by a control computer 14 of the inkjet printing machine 1. FIG. 3 shows the exemplary structure of such a system. The automated method in this case is integrated into the Workflow of the printing machine 1. The configuration of a control computer 15 with regard to individual method steps can be corrected manually in this case by the user as necessary.

The basis of the method according to the invention for compensating for failed printing nozzles is compensation by using adjacent printing nozzles. This approach is already known from the prior art. However, the use of a look-up table or LUT 17 with associated compensation probabilities and the calculation of the latter by using a color density wedge with various color densities and artificially introduced missing nozzle errors is new.

Figure 5:
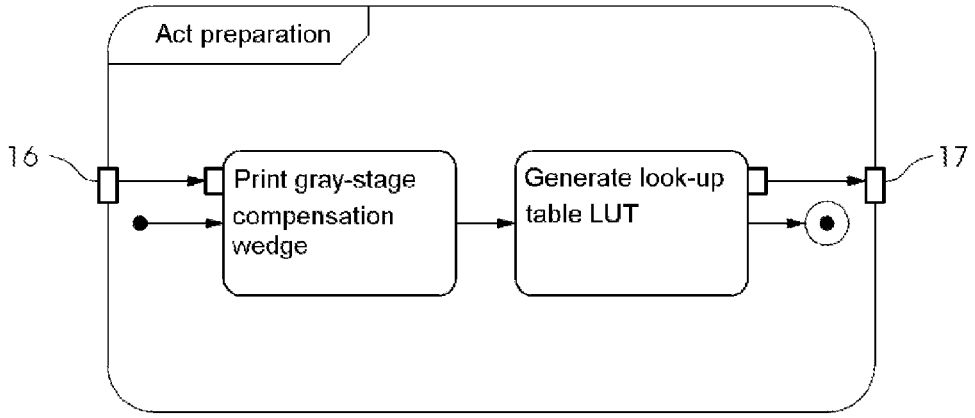
FIG. 5 is a flow diagram showing the sequence for preparing the method according to the invention.

The preferred exemplary embodiment is illustrated in FIG. 5. The method will be described for an individual color. In the case of multicolor printing it is applied independently for each color. In order to describe the method, it will be assumed that the print head 7 is able to produce three printing droplets (1, 2, 3) of different sizes, where 1 is the smallest droplet and 3 is the largest droplet. A value of 0, on the other hand, means that the intended droplet 18 is not set or the corresponding printing nozzle has failed. According to the invention, however, it can be applied to as many droplet sizes as desired.

Figure 4:
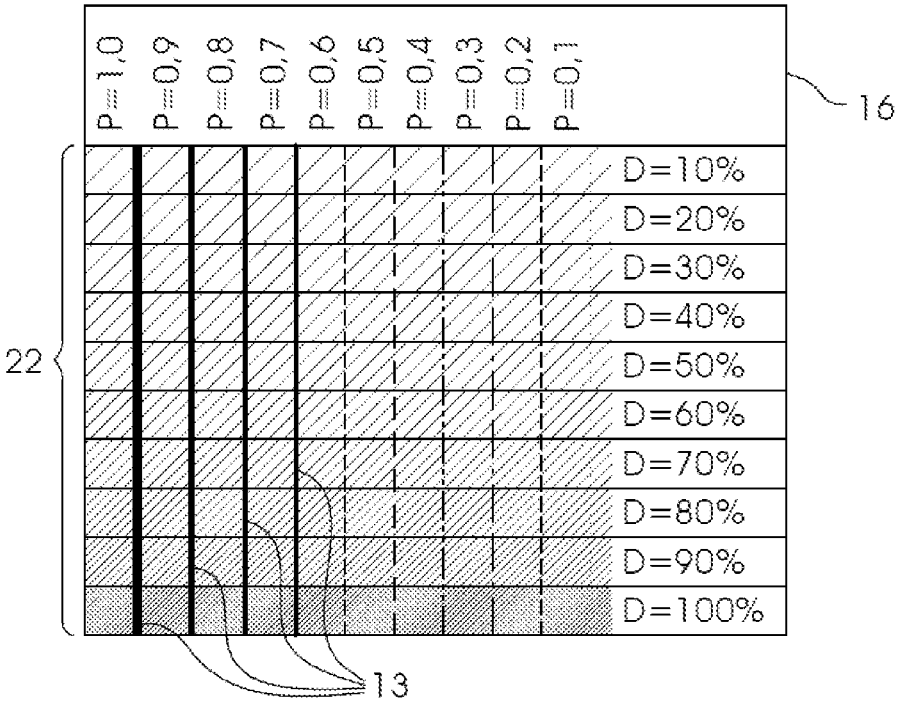
FIG. 4 is a plan view of an example of a test form for creating the LUT.

The method according to the invention includes a preparation step, which has to be carried out once for a specific material combination. Material combination means all substances and methods determining the print output quality. These include, amongst other things, the substrate on which printing is carried out, the ink used, the application method (waveform, droplet sizes, etc), the resolution, the drying parameters if they influence the spreading behavior of the ink, the screening process used and so on. The preparation step includes the steps illustrated in FIG. 5. A specific test form 16, which is shown in FIG. 4, includes a color density wedge 22 which, for example, is built up from 10 color densities D. Disposed transversely with respect to the course of the color densities are compensations for artificially introduced missing nozzle errors 13, which have been carried out with different compensation probabilities P. This test form 16 is printed for the above-described material combination. A decision is then made visually as to the compensation probability P for each color density D at which the best compensation effect is achieved. The compensation effect is optimal when neither a light nor a dark line can be detected. The evaluation can also be carried out with the aid of a camera with connected image processing. The values determined are stored in an LUT 17 that is specific to the material combination.

Figure 6:
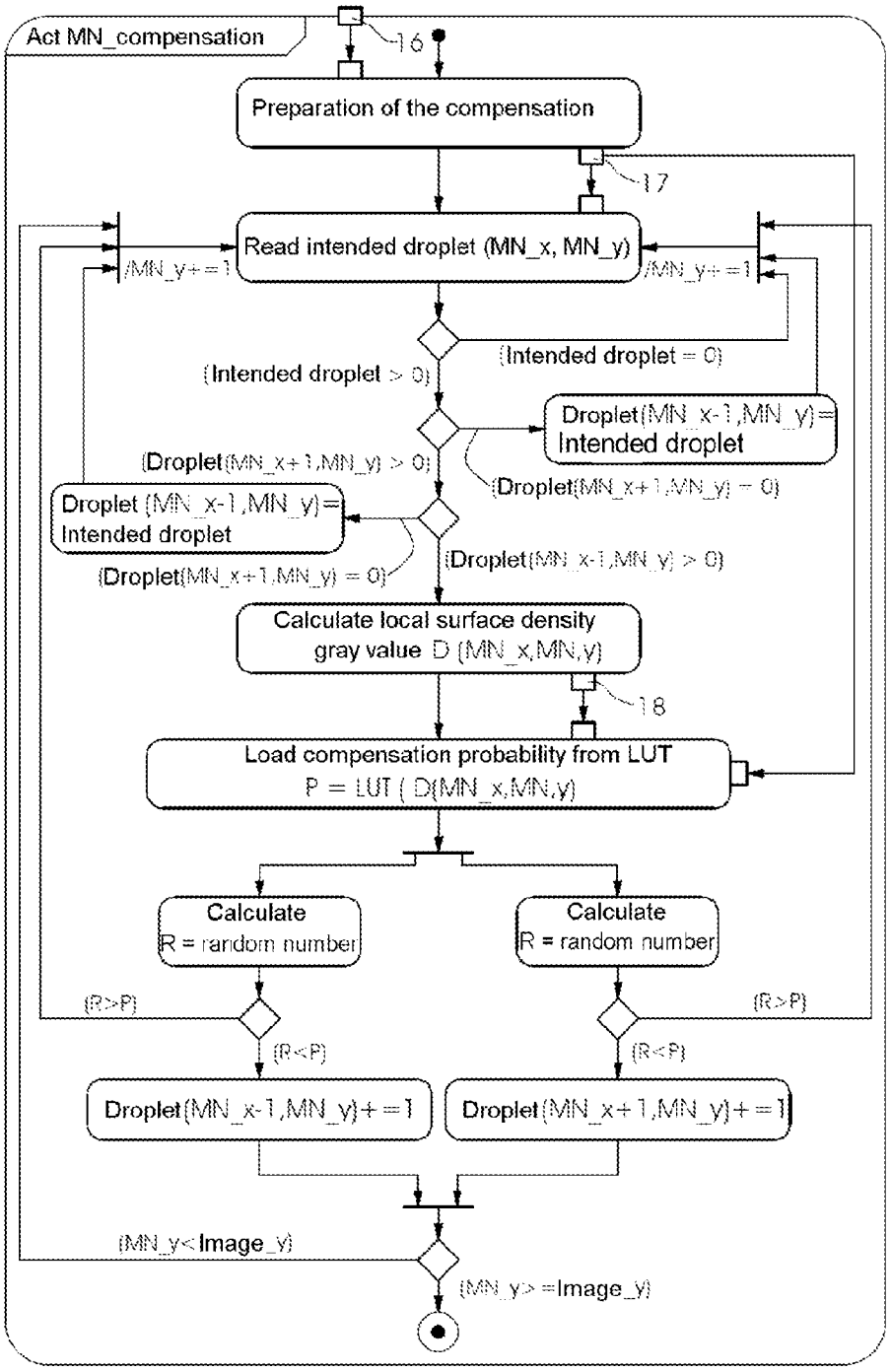
FIG. 6 is a flow diagram showing the sequence of the method according to the invention for compensating for a printing nozzle failure.
Figure 7:
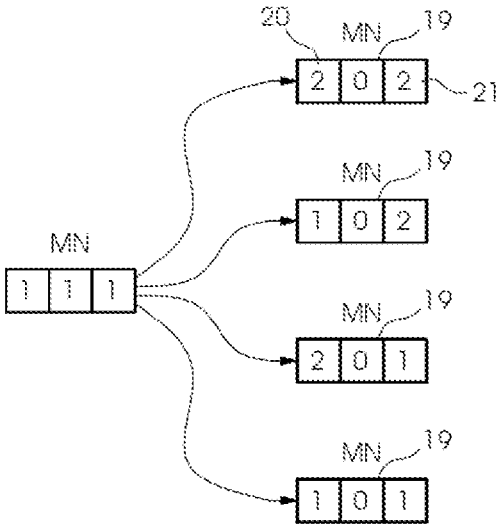
FIG. 7 is a flow diagram showing an example of compensation with one droplet size.

In order to correct one or more failed nozzles, the processing steps are carried out in accordance with FIG. 6 and FIG. 7. Firstly, the intended droplet 19 (MN) to be compensated for is read from the printing data. If no droplet is set to the left (MN_x−1) or to the right (MN_x+1) beside the droplet 19, the droplet 19 to be printed is placed there and the next is processed. As a result, one-pixel-wide structures are merely displaced and not hidden or depicted non-sharply. If both adjacent pixels 20, 21 are occupied, firstly the local surface density D 18 is calculated in accordance with the following formula, where Σdroplet describes the sum of all the droplet sizes (0-3), and maxdroplet describes the maximum droplet size:

$$D = \frac{\sum \text{droplet}}{25 \times \max \text{droplet}} \times 100\%$$

Preferably, the local surface density 18 is formed over a 5×5 grid. Since the compensation for a failed nozzle is to be carried out for an entire column, the calculation of the local surface density can be optimized. For this purpose, the 5×1 row sums are stored in a five-element ring buffer. In order to calculate the local surface density 18, work is then carried out with the sum of the elements of the ring buffer. This corresponds to the sum over all the pixels of the 5×5 matrix. With this step, both the number of computational steps and that of the memory accesses is minimized. By using the calculated local surface density, the compensation probability P is loaded from the above described LUT 17. In this case, recourse can be had to the nearest value in the LUT or, if appropriate, linear interpolation can be carried out.

In the next step, a pseudo-random number R in the value range between 0 and 1 is calculated both for the pixel on the left and the pixel on the right beside the pixel to be compensated for. If the random number is smaller than the compensation probability P loaded from the LUT 17, the droplet size is increased by one step. The process is then carried out for the next line in the image.

In FIG. 7, possible combinations of droplet sizes which can be produced for the compensation in the event of an increased compensation droplet size of 1 are indicated schematically. In this case, a 1 corresponds to the normal droplet size, a 2 to the increased compensation droplet size.

Figure 8:
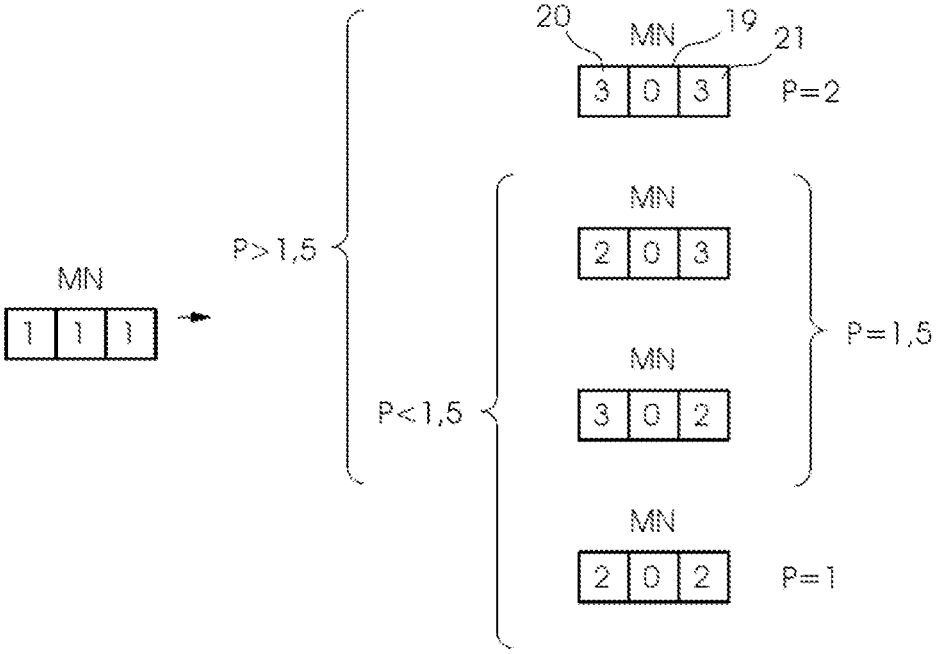
FIG. 8 is a flow diagram showing an example of compensation with two droplet sizes.

FIG. 8 shows, schematically, a variant of the method in which values up to 2 are permitted within the LUT. Therefore, it is possible to carry out a correction with up to 2 droplet sizes. The method can be expanded to as many droplet sizes as desired.

Figure 9:
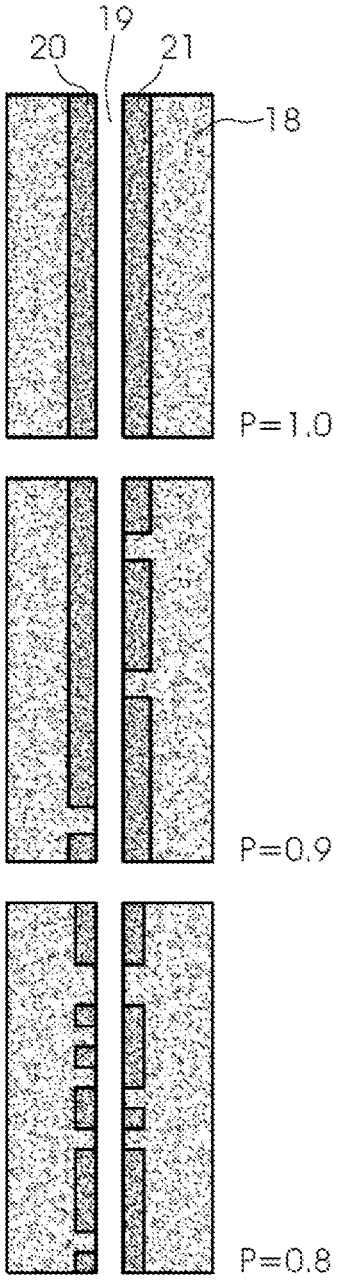
FIG. 9 is a plan view showing printed results with various compensation probabilities.

FIG. 9 shows the results along a missing nozzle for various probabilities P.

The invention claimed is:

1. A method for automatically compensating for failed printing nozzles in an inkjet printing machine by using a control computer, the method comprising the following steps:

printing a test form for a specific material combination;

evaluating the print of the test form and creating a look-up table including compensation probabilities from 0 to 1 as a function of local surface density;

detecting a failed printing nozzle;

reading, from printing data, a size of an intended droplet to be compensated for at a location of the failed printing nozzle;

calculating a local surface density at the location of the failed printing nozzle;

reading a compensation probability from the look-up table with the calculated local surface density;

calculating a pseudo-random number between 0 and 1 for a respectively adjacent pixel on the right and left of the pixel to be compensated for;

increasing the droplet size for the adjacent pixels on the right and left of the pixel to be compensated for if the respectively associated pseudo-random number for this pixel is lower than the compensation probability read from the look-up table;

calculating adjacent droplet sizes for all intended droplets to be compensated for at the location of the failed printing nozzle and using changed droplet sizes in the printing data; and carrying out a print job with the changed printing data.

2. The method according to claim 1, which further comprises selecting values between 1 and n as possible droplet sizes and increasing the adjacent pixels on the right and left of the pixel to be compensated for by the next largest droplet size, depending on the respectively associated pseudo-random number for this pixel.

3. The method according to claim 2, which further comprises providing the look-up table with compensation probabilities from 0 to 2 or higher, causing the pseudo-random number for the respective pixel to lie between 0 and 2, and therefore permitting an increase in the droplet size for the compensation by 2 or more.

4. The method according to claim 1, which further comprises providing the material combination with all parameters determining a print output quality, including substrate, ink, application method, resolution, drying parameters and screening process.

5. The method according to claim 1, which further comprises providing the test form with a color density wedge with various color densities into which simulated errors of failed printing nozzles have been introduced.

6. The method according to claim 1, which further comprises placing each respective intended droplet to be compensated for on the right or left of the location of the adjacent pixel if no droplet is set on this adjacent pixel.

7. The method according to claim 1, which further comprises carrying out the calculation of the local surface density over a grid of 5×5 pixels.

8. The method according to claim 7, which further comprises storing a sum of the droplet sizes in the 5×1 rows of the pixel grid in a ring buffer and carrying out the calculation of the local surface density by using a sum of elements of the ring buffer.

9. The method according to claim 1, which further comprises carrying out the method independently for the print head of each color for multicolor printing.

10. The method according to claim 1, which further comprises carrying out the method during screening by a Workflow control computer or in the printing machine by a local control computer of the printing machine.

11. The method according to claim 1, which further comprises carrying out the calculation and performance of the compensation in an automated manner by a control computer of the printing machine.

* * * * *